US006014846A

United States Patent [19]

Sono et al.

[11] Patent Number: 6,014,846

[45] Date of Patent: Jan. 18, 2000

[54] MULTI-WINDOW SASH AND BATTEN ATTACHMENT STRUCTURE

[75] Inventors: Yasuhiro Sono; So Koike; Masao Hirano, all of Toyama, Japan

[73] Assignee: YKK Architectural Products, Inc., Tokyo, Japan

[21] Appl. No.: 09/300,281

[22] Filed: Apr. 27, 1999

Related U.S. Application Data

[62] Division of application No. 08/891,731, Jul. 14, 1997.

[30] Foreign Application Priority Data

Jul. 18, 1996 [JP] Japan ..... 8-189224
Jul. 18, 1996 [JP] Japan ..... 8-189233

[51] Int. Cl.[7] ..... E06B 1/04; E06B 1/18; E06B 1/38; E06B 3/00

[52] U.S. Cl. ..... 52/204.1; 52/204.56; 52/204.6; 52/204.62; 52/204.67; 52/217; 52/592.4

[58] Field of Search ..... 52/204.1, 204.56, 52/204.6, 204.62, 204.67, 217, 592.4

[56] References Cited

U.S. PATENT DOCUMENTS 1,458,025 6/1923 Biele ..... 52/217
4,432,163 2/1984 Cassiere ..... 52/217 X

*Primary Examiner*—Christopher T. Kent
*Attorney, Agent, or Firm*—Finnegan, Henderson, Farabow, Garrett & Dunner, L.L.P.

[57] ABSTRACT

A multi-window sash comprising: a frame structure; a plurality of sash units, to each of which a panel is mounted which are connected with each other in a panel width direction, each of the sash units comprising bilateral vertical frame members, an upper frame member and a lower frame member which constitute a rectangular frame of the sash unit in combination thereof; and a mullion structure connecting adjacent two sash units and including at least a mullion having an expandable structure. The expandable mullion structure comprises a first mullion section attached to one sash unit and having one side surface in a panel width direction provided with a recessed portion and having water-tight member attachments and guide pieces which are attached to respective opposing inner surfaces of the recessed portion, water-tight members mounted to the respective water tight member attachments, and a second mullion structure attached to another one sash unit adjacent to the one sash unit and fitted to the recessed portion of the first mullion section in the panel width direction. The water-tight members are mounted so as to be pressed against both side end surfaces in a panel thickness direction of the second mullion section and the guide pieces are disposed so as to oppose to both the side end surfaces in the panel thickness direction of the second mullion section with gaps, respectively, to thereby impart an expandable function to the first and second mullion sections.

4 Claims, 9 Drawing Sheets

MULTI-WINDOW SASH AND BATTEN ATTACHMENT STRUCTURE

This is a division of application Ser. No. 08/891,731, filed Jul. 14, 1997.

BACKGROUND OF THE INVENTION

The present invention relates to a multi-window sash including a plurality of sash units which are connected together and mounted to a body of a building or the like and also relates to a batten attachment structure for mounting battens to a frame members constituting a panel mounting frame of such as multi-window sash, door, shoji-door, fixed sash window or the like to thereby fix a panel such as glass panel.

A multi-window sash constituted by connecting a plurality of sash units is provided with mullion structure which is expandable in a manner such that one mullion of one sash unit and another one mullion of an adjacent another one sash unit are fitted and connected together to be movable in a panel width direction (direction parallel to the surface of the panel).

For example, Japanese Utility Model Laid-open (KOKAI) Publication No. SHO 62-91876 discloses an expandable mullion structure in which one mullion section has a recessed portion directed to the panel width direction and another one mullion section has a protruded portion directed in the same direction, these recessed portion and protruded portion being fitted and abut-connected to each other through a water-tight member formed of such as rubber.

There is also known a simple structure for fixing the sash frame of the sash unit to the body of a building, in which fixing screws are screwed to the building body from bottom wall portions of recessed portions for mounting the panel to frame members constituting the sash frame.

Furthermore, there is also known a mounting structure of a door or shoji-door, in which a rectangular panel mounting frame is formed by assembling right and left side vertical frame elements, an upper frame element and a lower frame element each of which is formed with a recessed portion for supporting a panel, and the recessed portions of the respective frame elements are continuously connected so as to constitute a rectangular panel support recessed structure facing the panel when assembled as the panel mounting frame. A panel such as glass panel is fitted to the panel supporting recessed structure so as to be supported thereby.

Still furthermore, there is also known a mounting structure of a fixed sash window, in which a rectangular panel mounting frame is formed by assembling right and left side vertical frame members, an upper frame member and a lower frame member each of which is formed with a recessed portion for supporting a panel, and the recessed portions of the respective frame elements are continuously connected so as to constitute a rectangular panel support recessed structure facing the panel when assembled as the panel mounting frame, whereby a panel is fitted to the panel support recessed structure so as to be supported thereby.

In the door, the shoji-door and the fixed sash window mentioned above, the respective frame elements or frame members are assembled as a rectangular panel mounting frame and the panel is thereafter fitted to the panel support recessed structure of the panel mounting frame or element. Accordingly, in usual, the panel supporting portions are formed in a panel thickness direction (direction normal to the panel width direction) integrally with one side portions of the inner surfaces of the upper and lower frame elements and the upper and lower frame members, and battens are detachably mounted to the other side portions thereof, thus constituting upper and lower sections of the panel support recessed structures. Then, the panel supporting portions are integrally formed with both side portions in the panel thickness direction of the inner surfaces of the vertical frame element and the vertical frame member. Thereafter, the respective frame elements and the frame members are assembled as frames and the bilateral, i.e. right and left, vertical edge portions of the panel are fitted to the bilateral panel supporting recessed structures by moving bilaterally and obliquely the panel, and then, the battens are mounted to the upper and lower frame elements and the upper and lower frame members.

FIG. 10 shows one known example of such batten mentioned above, in which a first type batten F is composed of a box-shaped body la and one and another side engaging pieces 2*a* and 3*a* which are integrally mounted to the body la. The one and another side engaging pieces 2*a* and 3*a* are engageable with one and another side receiving pieces 5*a* and 6*a* integrally formed with an inner surface of a frame member 4*a* in a snap-engaging manner, thereby defining a panel support recessed structure 8*a* between such batten F and a panel supporting portion 7*a* formed to the frame member 4*a*.

Furthermore, FIG. 11 also shows another known example of such batten mentioned above, in which a second type batten G is composed of a hollow body 10*b* and one and another side hooks 11*b* and 12*b* integrally formed to the body 11*b*. The one and another side hooks 11*b* and 12*b* are fitted and engaged, in the panel thickness direction, with one and another side receiving pieces 14*b* and 15*b* integrally formed with an inner surface of a frame member 13*b*, thereby defining a panel support recessed structure 17*b* between such batten G and a panel supporting portion 16*b* of the frame member 13*b*.

However, according to the prior art structures or arrangements described above, the following problems will be provided.

When the mullion having the expandable structure mentioned above is adopted, although the connecting portions can be formed water-tightly by the location of the water-tight members, the relative movement amount of the one and another mullion sections in the panel width direction corresponds to a squeeze amount of the water-tight member, and moreover, since the squeeze amount thereof has its limit, it is difficult to increase the relative movement in the width direction of the panel to be fitted.

Furthermore, a large gap exists in the panel thickness direction between the recessed portion and the protruded portion in a state that the recessed portion of the one mullion section and the protruded portion of the another mullion section are fitted together, and accordingly, when a strong wind is applied, the these mullion sections are largely relatively moved in the thickness direction of the panel, providing a poor strength against the wind pressure and generating metallic noise due to collision of these mullion sections.

According to the fixing structure of the frame members mentioned above, the bottom portion of the panel mounting recessed structure and an abutting portion of the frame member against the building body are separated from each other in the panel width direction and the abutting portion is pressed against the building body through a seal member, so that a large gap exists between a head of the fixing screw (i.e. bottom portion of the panel mounting recessed portion) and the building body. Because of this reason, when a large force due to the wind pressure is applied to the sash frame in the panel thickness direction, since a large bending force or stress is applied to the fixing screw, the fixing screw may be bent or broken in an adverse case, thus being disadvantageous in strength.

Furthermore, when the arrangement of the first batten F as mentioned above is used, since the another engaging piece 3*a* is elastically engaged in the snap manner after the one engaging piece 2*a* has been engaged, the mounting of the batten F will be easily performed and the engagement between the batten and the frame can be firmly done when the panel is mounted, thus being improved in workability. However, in this arrangement, it is necessary for the another engaging piece 3*a* to be formed elastically deformable, so that when the wind pressure I is applied, there may cause a case where the another engaging piece 3*a* is elastically largely deformed and disengaged from the receiving piece of the frame member, thus the first batten F being not mounted to the panel mounting frame to which a large wind pressure will be applied.

Still furthermore, when the arrangement of the second batten G mentioned above is used, since the one and another hooks 11*b* and 12*b* are engaged with the one and another receiving pieces 14*b* and 15*b* through the fitting in the panel thickness direction, the engaging state can be maintained even if a strong wind pressure I is applied. However, the one and another hooks 11*b* and 12*b* are movable with respect to the one and another receiving pieces 14*b* and 15*b*, respectively, in the panel thickness direction by the external force, so that such engagement is likely disengaged from each other when the panel is mounted, thus providing bad workability. Moreover, when the batten G is mounted, since the one and another hooks 11*b* and 12*b* are fitted and engaged by sliding them in the panel thickness direction, the dimension of the frame member 13*b* in the thickness direction will be increased.

SUMMARY OF THE INVENTION

An object of the present invention is to substantially eliminate defects or drawbacks encountered in the prior art described above and to provide a multi-window sash and a batten attachment structure for mounting a batten therefor capable of firmly mounting and supporting a sash panel.

This and other objects can be achieved according to the present invention, there is provided, in one aspect, a multi-window sash comprising a plurality of sash units, to each of which a panel is mounted and which are connected with each other in a panel width direction, and mullion means connecting adjacent two sash units and including at least a mullion having an expandable structure, the expandable mullion means comprising:

a first mullion section having one side surface in a panel width direction provided with a recessed portion and having water-tight member attachments and guide pieces which are attached to respective opposing inner surfaces of the recessed portion; and a second mullion section fitted to the recessed portion of the first mullion section in the panel width direction, wherein water-tight members are mounted to the respective water-tight member attachments so as to be pressed against both side end surfaces in a panel thickness direction of the second mullion section and the guide pieces are disposed so as to oppose to both the side end surfaces in the panel thickness direction of the second mullion section with small gaps, respectively, to thereby impart an expandable function to the first and second mullion sections.

In another aspect, there is provided a multi-window sash comprising a plurality of sash units to each of which a panel is mounted and which include one end sash unit having a vertical frame member to be fixed to a building body to which the multi-window sash is mounted, wherein the vertical frame member is composed of a substantially box-shaped body having a panel support recessed portion opened to one side in a panel width direction and having an opening opened to another one side in the panel width direction and a frame attachment having a hollow structure attached to an edge portion of the opening of the box-shaped body, and the vertical frame member is fixed to the building body by means of fixing vis which extends from a bottom portion of the panel support recessed portion and penetrates the hollow structure of the frame attachment.

In a further aspect, there is provided a batten attachment structure for attaching a batten to a frame member of a sash to which a panel is mounted, the batten comprising:

a hollow body composed of an indoor side transverse plate member directed in a panel thickness direction, an outdoor side one side plate member directed in a panel width direction, an indoor side another one side plate member directed in the panel width direction and a connection transverse plate member integrally connected to, at one end, to an intermediate portion of the outdoor side one side plate member and, at another one end, to an end portion of the indoor side another one side plate member;

one side engaging piece integrally formed to the outdoor side one side plate member at a portion between the one connected end of the connection transverse plate member and a free end of the indoor side one side plate member; and another one side engaging piece integrally formed to the another one end of the connection transverse plate member so as to provide a linear extension, wherein the one side engaging piece is engaged in a snap engagement manner with one side receiving piece integrally formed to an inner surface of a frame member of a sash unit and the another one side engaging piece is engaged in a fit engagement manner with another one side receiving piece integrally formed to an inner surface of the frame member in the panel thickness direction, the another one side engaging piece being engaged with the another one side receiving piece with an engaging amount larger than a batten moving amount corresponding to a maximum elastic displacement of a portion of the outdoor side one plate member near the free end portion thereof.

In still further detailed aspects, there is provided a multi-window sash comprising:

a frame structure;

a plurality of sash units, to each of which a panel is mounted and which are connected with each other in a panel width direction, each of the sash units comprising bilateral vertical frame members, an upper frame member and a lower frame member which constitute a rectangular frame of the sash unit in combination thereof; and mullion means connecting adjacent two sash units and including at least a mullion having an expandable structure, said expandable mullion means comprising:

a first mullion section attached to one sash unit and having one side surface in a panel width direction provided with a recessed portion and having water-tight member attachments and guide pieces which are attached to respective opposing inner surfaces of the recessed portion;

water-tight members mounted to the respective water-tight member attachments; and a second mullion section attached to another one sash unit adjacent to the one sash unit and fitted to the recessed portion of the first mullion section in the panel width direction, wherein the water-tight members are mounted so as to be pressed against both side end surfaces in a panel thickness direction of the second mullion section and the guide pieces are disposed so as to oppose to both the side end surfaces in the panel thickness direction of the second mullion section with small gaps, respectively, to thereby impart an expandable function to the first and second mullion sections.

The water-tight member attachments are composed of recessed grooves into which the water-tight members are mounted, respectively, and said guide pieces project over the recessed grooves in the panel thickness direction.

There is also provided a multi-window sash comprising:

a frame structure;

a plurality of sash units, to each of which a panel is mounted and which are mounted to the frame structure and connected with each other in a panel width direction, each of the sash units comprising bilateral vertical frame members, an upper frame member and a lower frame member which constitute a rectangular frame of the sash unit in combination thereof and the sash units including one end sash unit having the vertical frame member to be fixed to a building body, the vertical frame member comprising:

a substantially box-shaped body having a panel support recessed portion opened to one side for mounting a panel in a panel width direction and having an opening opened to another one side to be attached to the building body in the panel width direction; and a frame attachment having a hollow structure attached to an edge portion of the opening of the another one side of the box-shaped body, wherein the vertical frame member is fixed to the building body by means of fixing vis which extends from a bottom portion of the panel support recessed portion and penetrates the hollow structure of the frame attachment.

A seal member is disposed between the box-shaped body of the vertical frame member and the building body.

There is also provided a multi-window sash comprising:

a frame structure;

a plurality of sash units, to each of which a panel is mounted and which are connected with each other in a panel width direction, each of the sash units comprising bilateral vertical frame members, an upper frame member and a lower frame member which constitute a rectangular frame of the sash unit in combination thereof;

a mullion connecting adjacent two sash units and comprising a first mullion section having a recessed portion and a second mullion section fitted to the recessed portion of the first mullion section;

a lower flushing member disposed to lower portions of the lower frame members of the respective sash units so as to extend entirely in the panel width direction of the multi-window sash in a mounting state;

a connecting member for connecting the mullion to the lower flushing member; and a pair of guide blocks by which the mullion is fixed to the lower flushing member.

The connecting member has a T-shaped structure having a transverse piece which is fixed to the lower flushing member by means of bolt and a vertical piece fixed to the second mullion section. The guide blocks are disposed between inner surfaces of the recessed portion of the first mullion section and both end surfaces of the vertical piece of the connecting member in the panel thickness direction.

There is also provided a multi-window sash comprising:

a frame structure;

a plurality of sash units which include a first group thereof and a second group thereof which is arranged in a direction normal to the arrangement of the first group, to each of which a panel is mounted and which are connected to each other in a panel width direction, each of the sash units comprising bilateral vertical frame members, an upper frame member and a lower frame member which constitute a rectangular frame of the sash unit in combination thereof; and a corner mullion connecting adjacent two sash units at a corner portion at which the first group and second group of the sash units are connected by the corner mullion with a right angle, the corner mullion comprising a first hollow structure rectangular in section defined by first, second, third and fourth plate members, a second hollow structure rectangular in section defined by first, second, third and fourth plate members and disposed inside the first hollow structure with third and fourth plate members of the first and second hollow structures being common, a connecting member connecting an inner corner portion between the first and second plate members of the first hollow structure and outer corner portion between the first and second plate members of the second hollow structure, and a reinforcing member disposed between an inner corner portion between the first and second plate members of the second hollow structure and a common corner portion of the first and second hollow structures between the third and fourth plate members thereof, the first and second plate members of the first hollow structure being formed with recessed portions into which panels are mounted with an angle perpendicular to each other.

The connecting member and the reinforcing member are disposed linearly in a diagonal direction of the first and second hollow structures of the corner mullion. The reinforcing member is fitted to the corner portions of the second hollow structure in a snap engagement manner by means of guides.

According to the present invention, many other organic combination of the embodiments or examples described above may be made without specific efforts by persons skilled in the art.

According to the first aspect of the present invention of the characters described above, since the water-tight members are press contacted to both the end surfaces of the second mullion section in the panel thickness direction, the relative movement in the panel width direction between the first and second mullion sections can be made large regardless of the squeeze amount of the water-tight members, and even if both the mullions are relatively moved in the panel width direction, the contacting condition of the water-tight members can be always maintained constant, thus maintaining an improved water-tight performance.

Furthermore, when the positive or negative wind pressure is applied to the sash, although the first and second mullion sections may be relatively moved in the panel thickness direction, the movement amount thereof substantially corresponds to a small gap between the guide pieces and both the end surfaces of the second mullion section in the panel thickness direction, so that the positional displacement of both the mullion sections can be maintained minutely.

Accordingly, the mullion can be prevented from being deformed by the wind pressure by the sum of the strengths of the first and second mullion sections with an improved water-tight performance being maintained.

According to the another aspect of the present invention, since the fixing vis is supported by the hollow structure of the frame attachment, the bending stress is merely partially applied to a portion between the frame attachment and the building body. Therefore, the vis is hardly bent or damaged even if a large wind pressure, for example, is applied thereto.

According to the further aspect of the present invention, the batten can be attached to the frame member of the sash by elastically deforming the one side engaging piece and snap engaging it with the one side receiving piece after the another one side engaging piece is engaged with the another one side receiving piece. Accordingly, the panel thickness directional dimension of the frame member is not made large more than necessity, and moreover, the batten is hardly removed from the frame member when the panel is mounted, thus providing an improved workability.

Furthermore, even if a large wind pressure (positive) is applied to the body of the sash, the body is hardly deformed, and even if the one side plate member is elastically deformed through the elastic engagement of the one side engaging piece, the another side engagement is firmly maintained, so that the batten cannot be disengaged.

Still furthermore, since no bending stress is applied to the another side engaging piece, it is not disengaged from the another one side receiving piece, so that the batten cannot be disengaged even if a large wind pressure (negative) is applied.

According to a still further aspect of the present invention, there is provided a corner mullion having an improved structure in which the first and second hollow structures are reinforced by means of the reinforcing member in a simple manner, so that the corner mullion can be easily reinforced and can maintain the improved strength against the wind pressure in a specific direction.

The nature and further characteristic features of the present invention will be made more clear from the following descriptions made with reference to the accompanying drawings.

DESCRIPTION OF THE PREFERRED EMBODIMENTS

Figure 1:
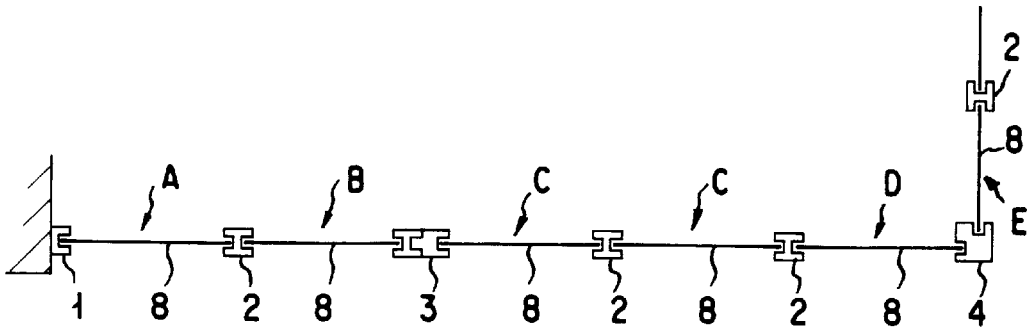
FIG. 1 is an illustration of a sectional view of a multi-window sash arrangement composed of a plurality of sash units according to first embodiment of the present invention.
Figure 2:
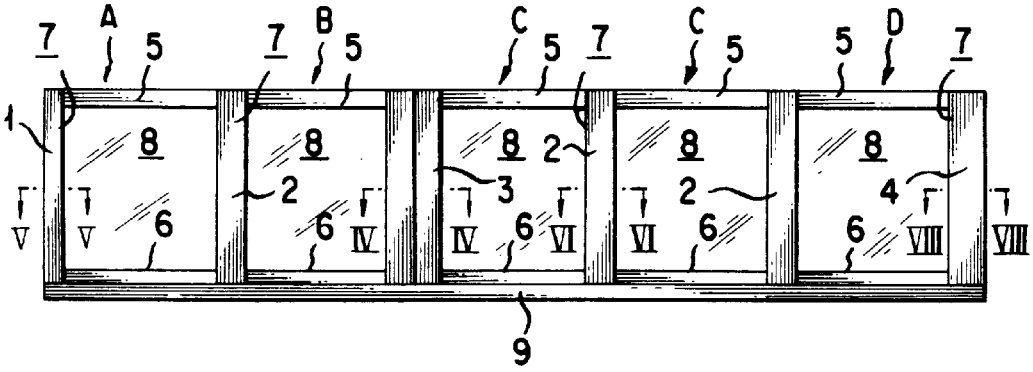
FIG. 2 is a front view of the arrangement of the multi-window sash of FIG. 1.

With reference to FIGS. 1 and 2, a multi-window sash is composed of a plurality of sash units A, B, C and D which are sectioned by frame bodies 7 constituted by a vertical frame member 1, a mullion 2, an expandable mullion 3 and a corner mullion 4 and upper and lower transverse frame members 5 and 6 transversely connecting the vertical frame member 1 and the respective mullions 2, 3 and 4. A panel 8 is applied to each of the frame body 7 and the respective sash units A, B, C and D are mutually connected by a lower flushing member 9 secured to the respective lower transverse frame members 6.

Figure 3:
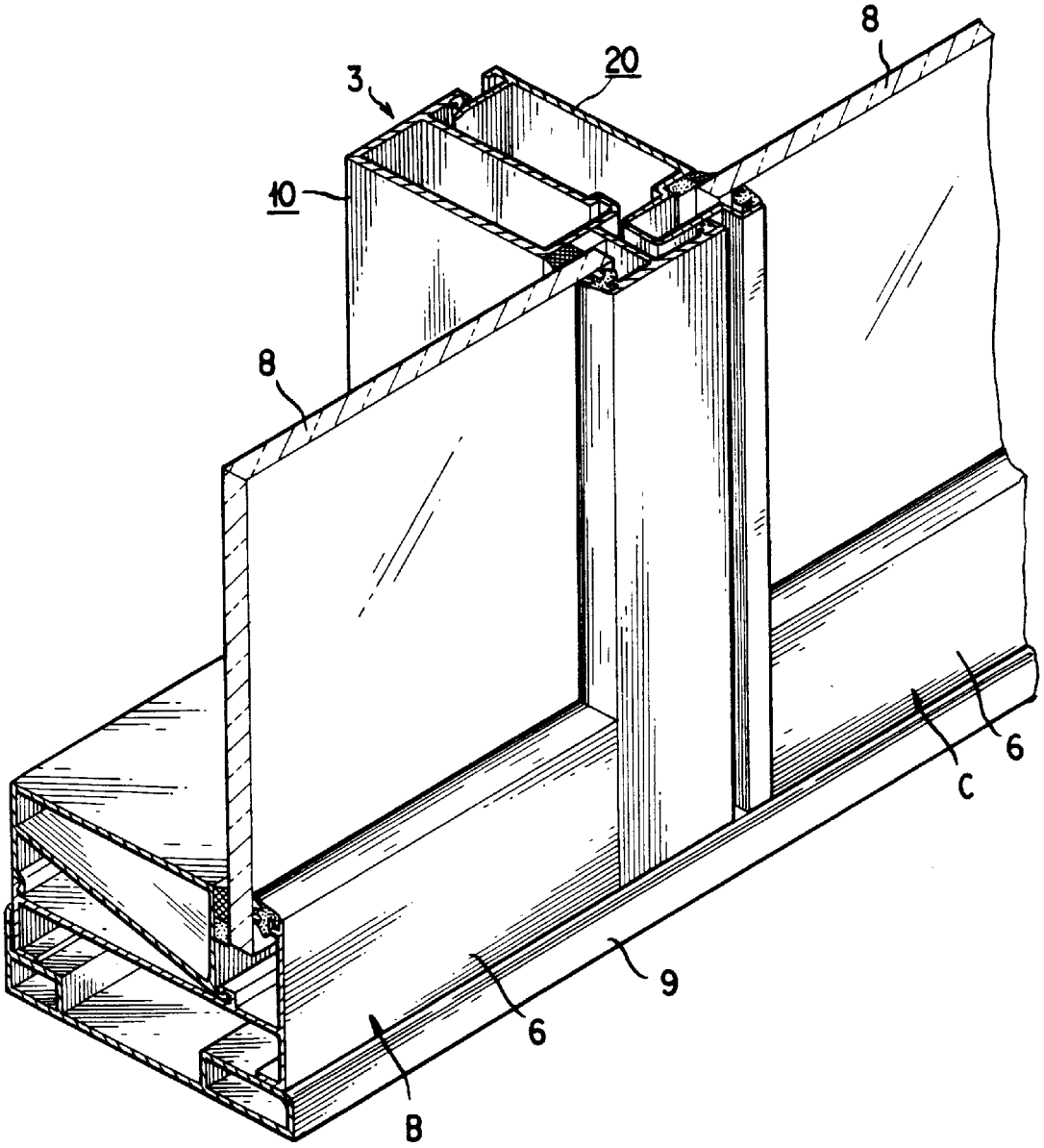
FIG. 3 is a perspective view, in an enlarged scale, of an expandable mullion for a connecting portion of adjacent two sash units, representing first example of a mullion adapted to the present invention.

The mullion 3 having an expandable function is composed of, as shown in FIG. 3, a first mullion section 10 and a second mullion section 20 to be expandable in the panel width direction, and the first mullion section 10 constitutes the mullion of one sash unit B and the second mullion section 20 constitutes the mullion of adjacent another one sash unit C.

Figure 4:
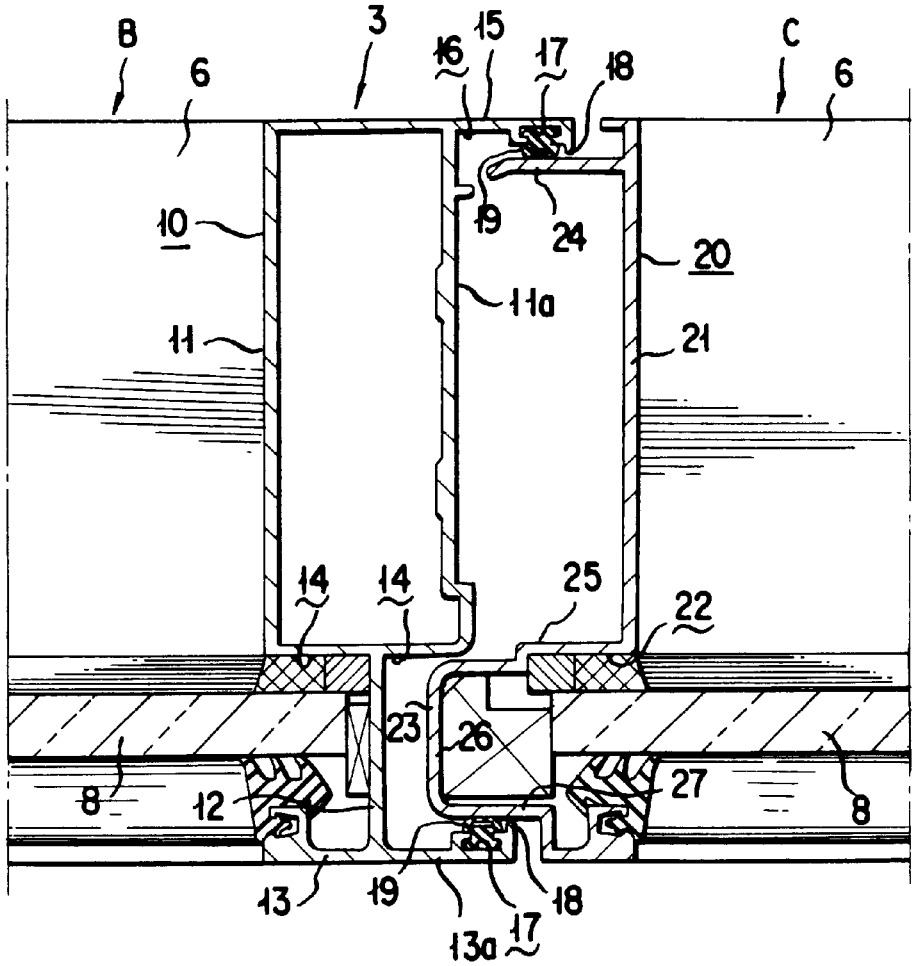
FIG. 4 is a sectional view of the expandable mullion taken along the line IV—IV in FIG. 2.

As shown in FIG. 4, the first mullion section 10 has a recessed structure 14 composed of a hollow indoor side member 11, a projecting plate member 12 and a plate-shaped outdoor side member 13 and opened towards both side portions in the panel width direction A support projecting plate member 15 is integrally formed to one side surface of the indoor side member 11 at an indoor side portion thereof in the panel width side direction. A recessed structure 16 having a wide width for connecting the mullion sections is formed by the support projecting plate member 15 and one side portion 13*a* of the outdoor side member 13.

Recessed grooves 17 and guide pieces 18 projecting in the outdoor side direction from the grooves 17 are formed to the support projecting plate member 15 and the one side portion 13*a* of the outdoor side member 13, respectively, in a manner such that the recessed grooves 17 and the guide pieces 18 in the panel width direction are formed to the inner surfaces opposing, i.e. facing, in the panel thickness direction, of the recessed structure 16 for the mullion connection. Water-tight members 19 are fitted in the respective grooves 17 so as to direct towards the panel thickness direction.

As also shown in FIG. 4, the second mullion section 20 is composed of a plate-shaped indoor side member 21 directing towards the panel thickness direction, an outdoor side member 23 provided with a recessed portion 22 and a projecting plate member 24 integrally formed to the indoor side portion of the indoor side member 21 so as to extend in the panel width direction.

The outdoor side member 23 has a box-shape structure composed of one side plate member 25 integrally connected to the indoor side member 21 so as to direct to the panel width direction, a connection plate member 26 integrally connected to the one side plate member 25 so as to direct to the panel thickness direction and another side plate member 27 integrally connected to the connection plate member 26 so as to direct to the panel width direction. The one and another side plate members 25 and 27 are bent so as to provide a crank-shape.

According to the structure mentioned above, a dimension of the recessed portion 22 of the outdoor side member 23 at the open edge side is made large and a dimension thereof at the bottom side is made small, the panel 8 can be mounted to the recessed portion 22 and the recessed structure 14 of the first mullion section 11 with the same mounting structure, and moreover, the bottom side portion of the outdoor side member 23 can be fitted within the another recessed groove 14 of the first mullion section 10. The another side plate member 27 of the outdoor side member 23 (one side end face of the second mullion section 20 in the panel thickness direction) and the projecting plate member 24 (another one side end face of the second mullion section 20 in the panel thickness direction) are fitted into the recessed structure 16 of the first mullion 10 and pressed against the water-tight members 19 to attain the water-tight performance at the connecting portion.

The gap between the another side plate member 27 of the outdoor side member 23 and one guide piece 18 and the gap between the projecting plate member 24 and the another one guide piece 18 are each very small, for example, a clearance of a section member. The gap between the another one recessed groove 14 of the first mullion section 10 and the outdoor side member 23 of the second mullion section 20 is also made likely small.

As mentioned above, since the water-tight members 19 is press contacted to the projecting plate member 24 and the another side plate member 27 in the panel thickness direction, the relative movement amount of the first and second mullion sections 10 and 20 in the panel width direction can be made large regardless of the squeeze amount of the water-tight members, and even if the first and second mullion sections 10 and 20 are relatively moved in the panel width direction, the press-contacting condition of the water-tight members 19 can be maintained always constant, thus keeping the improved water-tight performance thereof.

Further, when the positive or negative wind pressure is applied to the panel 8, although the first and second mullion sections 10 and 20 are relatively moved in the panel thickness direction, the moving amount corresponds to the gap between the another side plate member 27 and the guide piece 18 or between the projecting plate member 24 and the guide piece 18. Therefore, the positional displacement of the first and second mullion sections 10 and 20 in the panel thickness direction is very small.

According to the structure mentioned above, the water-tight performance at the connecting portion can be surely maintained, and moreover, the wind pressure load is transferred between the first and second mullion sections 10 and 20 and, hence, the mullion 3 can be prevented from being deformed by the sum of the strengths of the first and second mullion sections 10 and 20.

Figure 5:
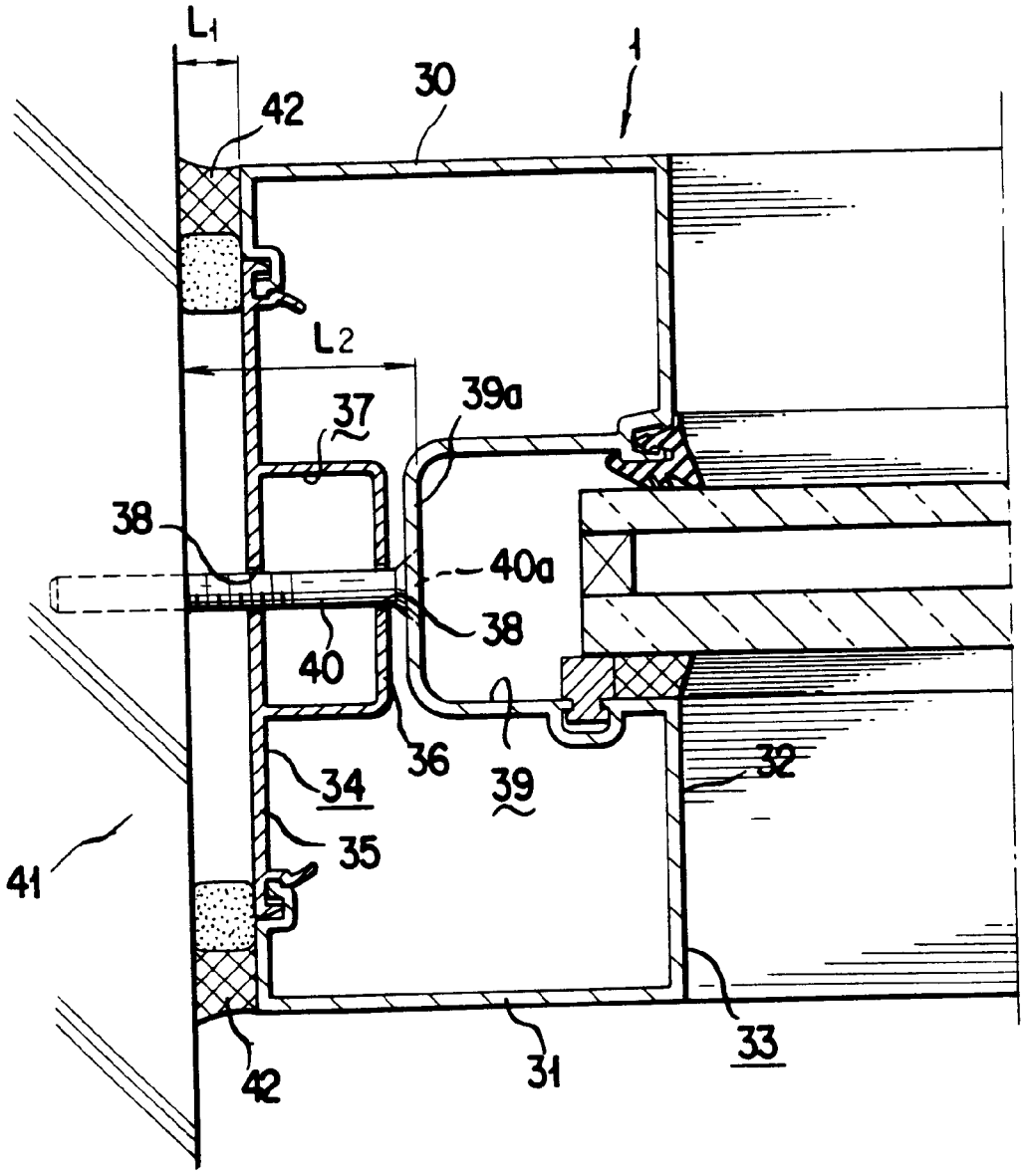
FIG. 5 is a sectional view of a mullion adapted to a vertical frame member of a sash structure taken along the line V—V in FIG. 2, representing a second embodiment of the present invention.

FIG. 5 shows a second embodiment of the present invention which is applied to the vertical frame member 1.

With reference to FIG. 5, the vertical frame member 1 comprises an open box-shaped body 33 and a frame attachment 34. The box-shaped body 33 is composed of one and another side plate members 30 and 31 positioned in the panel thickness direction and a connection plate member 32 integrally connecting the one and another side plate members 30 and 31. The frame attachment 34 is mounted through snap engagement to the one and another side plate members 30 and 31 of the body 33, and the frame attachment 34 has a small length and is attached only to a portion to which a fixing screw 40 is fastened as mentioned hereinlater. The attachment 34 is composed of a plate piece 35 and a box-shaped piece 36 integrally formed to the plate piece 35 so as to provide a hollow structure 37, and holes 38 are formed to a bottom portion of the box-shaped piece 36 and the plate piece 35 in an opposing alignment.

The connection plate member 32 is formed with a panel mounting recessed portion 39 having a bottom section 39*a* to which is formed a hole to which the fixing screw 40 is engaged so as to extend through and into the holes 38 formed to the frame attachment 34 and to engage with a building body 41, thus attaching the vertical frame member 1 to the building body 41. Seal members 42 are disposed between the building body 41 and the one and another side plate members 30 and 31 of the vertical frame member 1.

According to the location of the frame attachment 34 in the manner mentioned above, the head side portion 40*a* of the fixing screw 40 is supported by the frame attachment 34 and only the portion of the screw 40 between the frame attachment 34 and the building body 41 (having a small dimension L1) is subjected to a bending stress, for example, at a time when the wind pressure is applied thereto. On the other hand, in the absence of such frame attachment 34, a portion of the fixing screw 40 between the bottom section 39*a* of the panel mounting recessed portion 39 and the building body 41 (having a long dimension L2). Therefore, the bending stress applied to the fixing screw 40 can be made significantly small by the location of the frame attachment 34 to the vertical frame member 1, when the same wind pressure is applied thereto, in comparison with the case of no location of the frame attachment 34.

Figure 6:
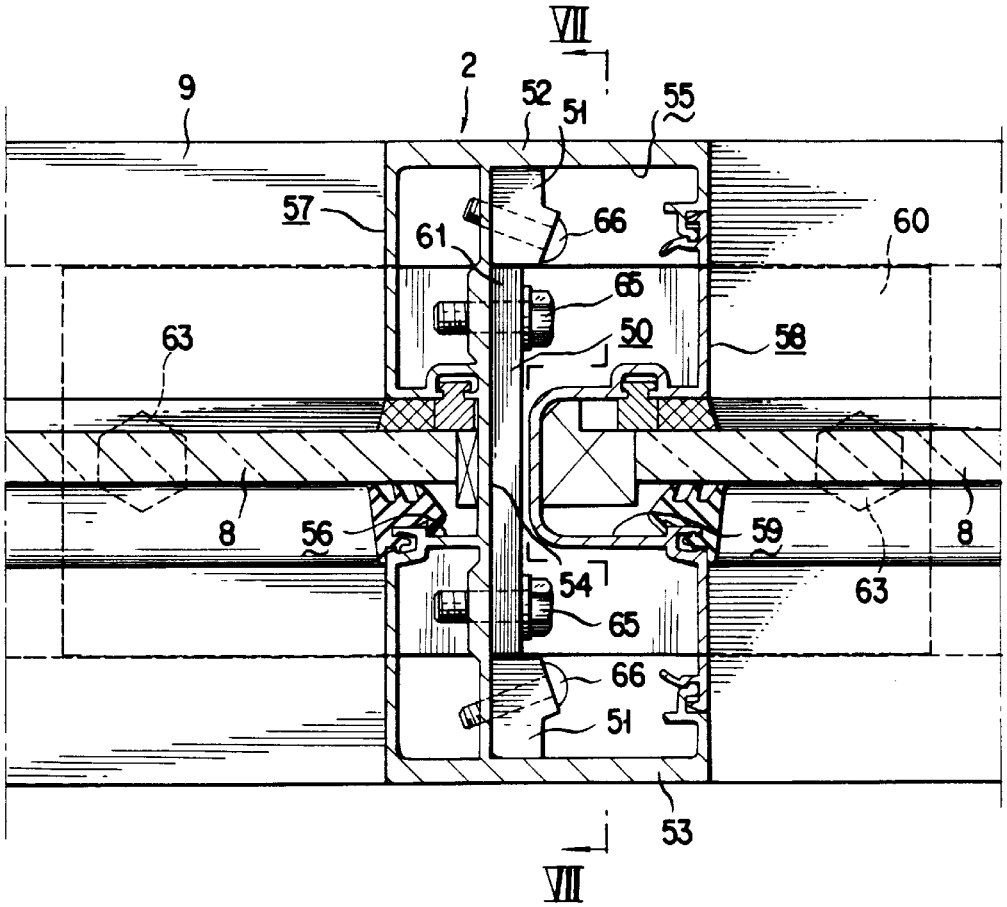
FIG. 6 is a sectional view taken along the line VI—VI in FIG. 2, representing a second example of the mullion for the present invention.

FIG. 6 represents a second example of a mullion disposed between the vertical frame member 1 and the expandable mullion 3 in FIG. 1 or 2.

With reference to FIG. 6, the mullion 2 is connected to the lower flushing member 9 by means of a connection fitting 50 and a pair of guide blocks 51.

That is, in more detail, the mullion 2 has a separation type structure having a first mullion section 57 and a second mullion section 58. The first mullion section 57 is composed of one and another side plate members 52 and 53 in the panel thickness direction and a connection plate member 54 connecting these side plate members 52 and 53 so as to provide a box-shape having an opening on one side in the panel width direction as a recessed portion 55, and a panel supporting recessed portion 56 formed on another one side in the panel width direction. The second mullion section 58 is snap-engaged with the opening end of the recessed portion 55 of the first mullion section 57, and the second mullion section 57 is formed with a panel supporting recessed portion 59, which corresponding to the panel supporting recessed portion 56 of the first mullion section 57 in alignment.

Figure 7:
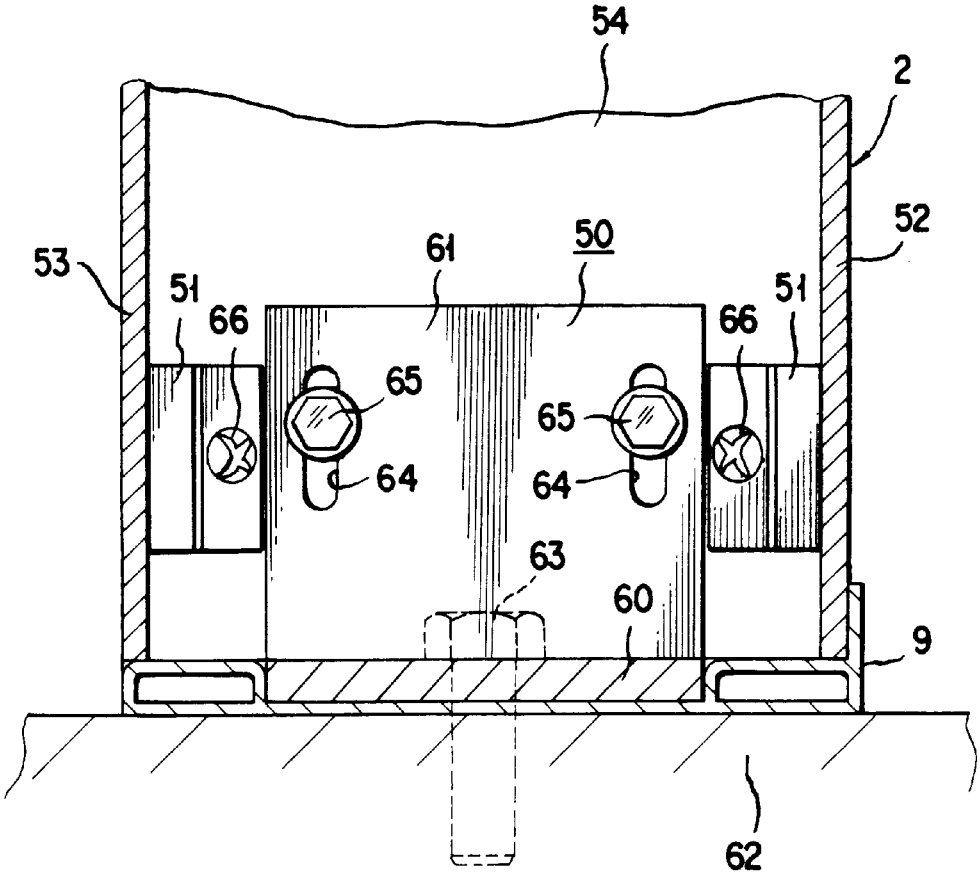
FIG. 7 is a sectional view taken along the line VII—VII in FIG. 6.

The connection fitting 50 is composed of, as shown in FIG. 7, a transverse piece 60 and a vertical piece 61 so as to provide a T-shape structure. The transverse piece 60 is fixed by means of an anchor bolt 63 penetrating the lower flushing member 9 and screwed with a building body 62, and the vertical piece 61 is secured to the connection member 54 of the first mullion section 57 by means of bolt 65 penetrating a vertical slot 64 formed to the vertical piece 61.

The guide blocks 51 are fixed, by means of vises, to the connection member 54 of the mullion 2 at both side portions thereof in the panel thickness direction in a manner such that the guide blocks 51 contact an inner surface of the one side member 52 in the panel thickness direction and an inner surface of the another side member 53 in the same direction and also contact both end surfaces of the vertical piece 61 in the panel thickness direction.

According to the structure of the mullion 2 mentioned above, when a load, such as wind pressure, in the panel thickness direction is applied to the mullion 2, one of the guide blocks 51 abuts against the vertical piece 61 of the connection fitting 50 to thereby carry the load, providing an improved connection strength with a simple structure of the connection fitting 50.

Figure 8:
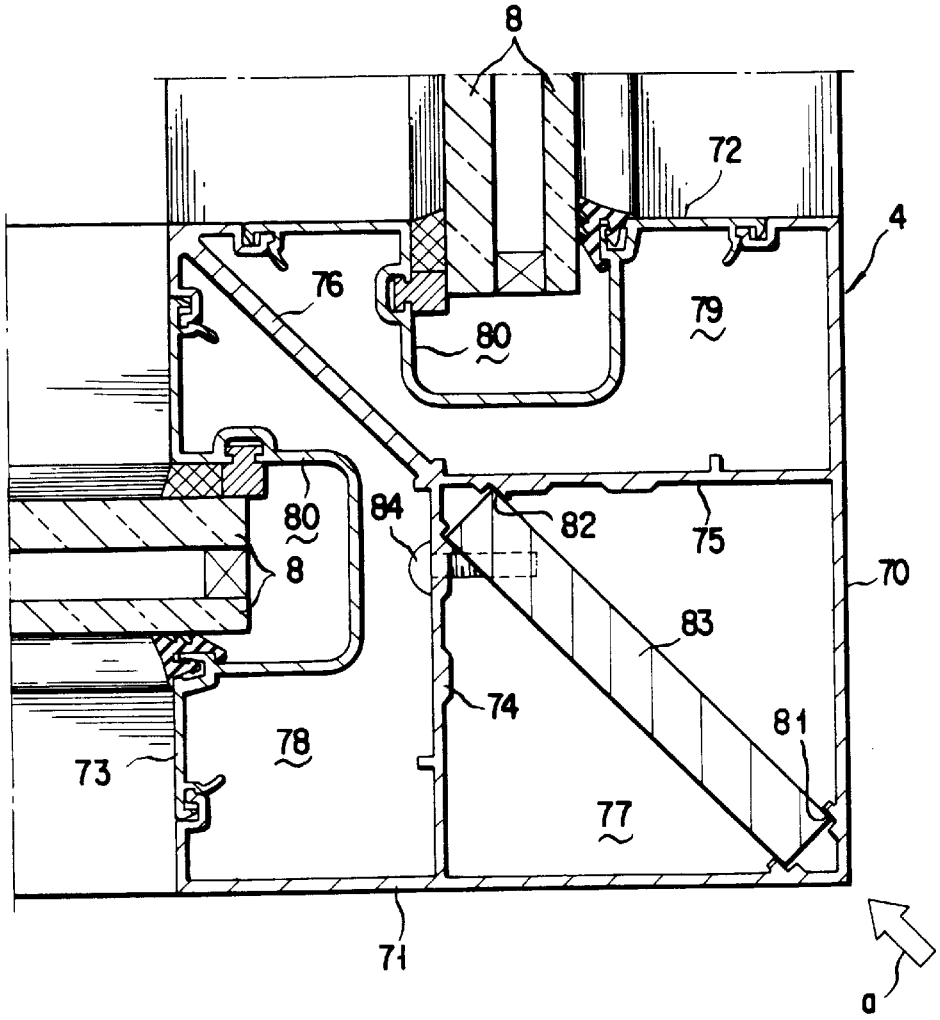
FIG. 8 is a sectional view taken along the line VIII—VIII in FIG. 2, representing a third example of a mullion as a corner mullion adapted to the sash of the present invention.

FIG. 8 represents a third example of a mullion, i.e. corner mullion of the present invention, which is disposed between adjacent two panels 8 in the right angled arrangement.

With reference to FIG. 8, the corner mullion 4 has a rectangular section having four corner portions of 90o. When the wind is applied to the corner mullion 4 in a direction (arrow a) with an angle of 45o with respect to the surface of the panel 8, the most large wind load will be applied thereto, and accordingly, it is desired in efficiency to provide a reinforcement so that a sectional secondary moment is maximally achieved in the direction of 45°. Taking this matter into consideration, the corner mullion 4 of the present invention has a shape shown in FIG. 8. That is, the corner mullion 4 is composed of first, second, third and fourth outside vertical plate members 70, 71, 72 and 73, first and second inside L-shaped vertical plate members 74 and 75 fixed to the first and second vertical plate members 70 and 71, respectively, and a connection plate member 76 fixed to the connecting corner portion between the third and fourth outside vertical plate members 72 and 73 and the connecting corner portion between the first and second inside vertical plate members 74 and 75. According to this arrangement, the corner mullion 4 provides an vertically elongated hollow structure, rectangular in section, having first and second hollow sections 78 and 79.

The third and fourth outside vertical plate members 72 and 73 are formed independently from the other members and snap-fitted thereto and formed with panel support recessed portions 80, respectively.

A flat plate shape reinforcing member 83 is fitted in the hollow structure 77 fixed to guide portions 81 and 82 provided at the connecting corner portions between the first and second outside vertical plate members 70 and 71 and between the first and second inside vertical plate members 74 and 75.

The reinforcing member 83 and the connecting vertical plate member 76 are thus arranged linearly continuously to thereby reinforce the corner mullion 4 in the diagonal direction thereof. Although it is not particularly necessary to support the reinforcing member 83, it will be desired to be fixed to the first inside vertical plate member 74 so as to prevent it from dropping down at the time of assembling.

According to the arrangement mentioned above, the corner mullion 4 can be reinforced in the most efficient manner against the strong wind in the direction of 45o with respect to the panel 8. Furthermore, since only one reinforcing member 83 is arranged, the total weight of the corner mullion 4 is not so large and has a simple structure.

Still furthermore, since the reinforcing member 83 is fitted to the guide portions 81 and 82 formed to the diagonally opposing two corner portions of the hollow structure 77, an external force applied to the corner mullion 4 in the diagonal direction thereof can be transferred through the reinforcing member 83, and since the reinforcing member 83 is not fixed firmly by means of bolts or the like, it can be simply arranged.

Figure 9:
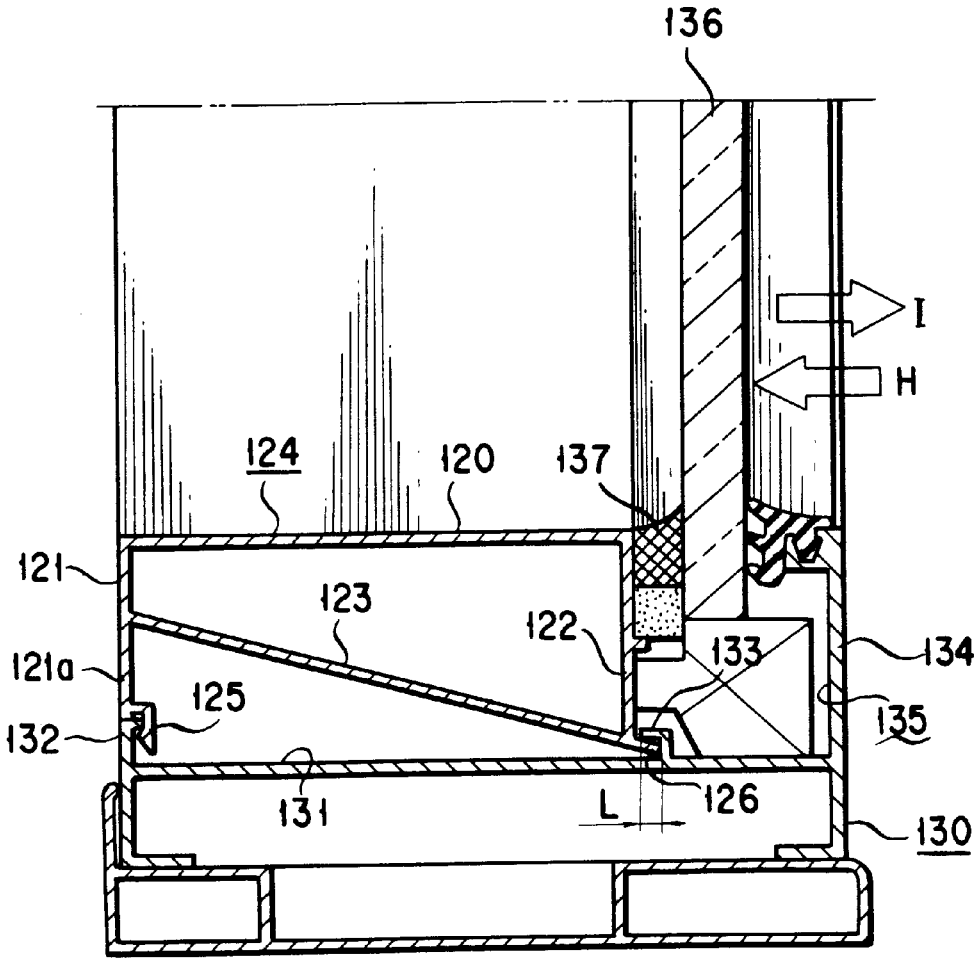
FIG. 9 is a sectional view of a third embodiment of the present invention showing a batten attachment structure for the sash.
Figure 10:
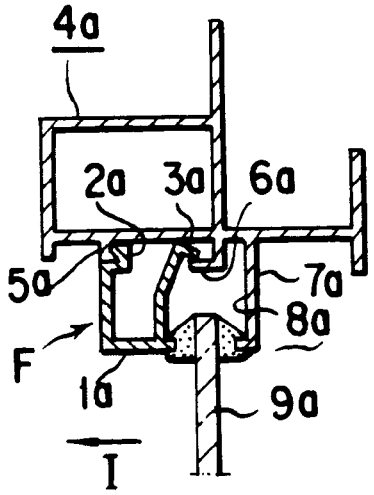
FIG. 10 PRIOR ART
FIG. 10 is a sectional view showing a first conventional batten mounting structure.
Figure 11:
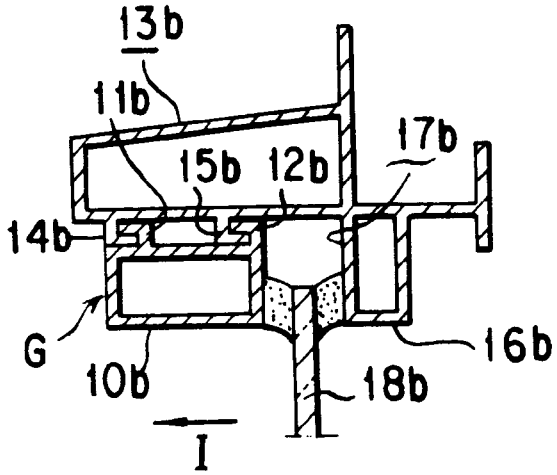
FIG. 11 PRIOR ART
FIG. 11 is also a sectional view showing a second conventional batten mounting structure.

FIG. 9 represents a third embodiment of the present invention showing a batten attachment structure.

With reference to FIG. 9, a hollow structure body 124 is composed of an inside transverse plate member 120 directed in the panel thickness direction, an outdoor side one plate member 121 directed in the panel width direction, an indoor side another plate member 122 directed in the panel width direction and a connection transverse plate member 123 obliquely directed in the panel thickness direction.

The connection transverse plate member 123 is linearly disposed between and fixed to an intermediate portion of the outdoor side one plate member 121 and one end portion of the indoor side another plate member 122 with an oblique inclination with respect to the transverse plate member 120. The connection transverse plate member 123 has one end portion connected to the outdoor side one plate member 121 and another end portion extending in the indoor side from the indoor side another plate member 122 to form another side engaging piece 126.

The outdoor side one plate member 121 has a free end to which one side engaging piece 125 is integrally attached, which is directed downward as viewed in FIG. 9, and the engaging piece 125 is engageable with one side receiving piece 132 in a snap engagement manner by elastically deforming a portion 121*a* between the connected end portion of the connection plate member 123 and the free end of the outdoor side one plate member 121.

The connection plate member 123 has one end portion connected to the outdoor side one plate member 121 and another end portion extending in the indoor side from the indoor side another plate member 122 to form another side engaging piece 126.

The receiving piece 132 having a hook shape is integrally formed to one end in the outdoor side of an inner plate-like portion 131 of the lower frame member 130, for example, and another receiving piece 133 having a hook shape is also integrally formed to the indoor side portion of the inner plate-like portion 131. A panel support plate member 134 is integrally formed to the end portion of the plate-like portion 131 in the panel thickness direction.

A batten is constructed by fitting and engaging the another side receiving piece 133 to and with the another side engaging piece 126 and, under this condition, by snap engaging the one side engaging piece 125 with the one side receiving piece 132 through the elastic deformation of the portion 121*a* of the outdoor side one plate member 121.

According to the structure mentioned above with reference to FIG. 9, since the one side engaging piece 125 is snap engaged with the one side receiving piece 132 with the elastic restoring force, the batten is hardly disengaged at a time when a panel 136 is mounted with a panel support recessed structure 135 constituted by the plate-like portion 131 and the panel support portion 134 of the lower frame member 130, thus providing an improved workability.

Furthermore, since the batten can be mounted in the snap engagement manner from the panel width direction, the panel thickness directional dimension of an upper frame member 130 is not made large more than necessity.

As mentioned above, even if the batten is pushed in the indoor side direction by a large wind pressure (positive pressure H) acting on the panel 136, the hollow body 124 is not deformed thereby and the portion 121*a* of the outdoor side one plate member 121 is elastically deformed and the batten is moved in the panel thickness direction, but the another side engaging piece 126 is not disengaged from the another side receiving piece 133.

Still furthermore, when the batten is drawn towards the outdoor side through a sealing member 137 disposed between the panel 136 and the hollow body 124 by a large wind pressure (negative pressure I) acting on the panel 136, the hollow body 124 is not deformed and the batten is not disengaged because any bending stress is not applied to the another side engaging piece 126. Since the wind pressure I is larger than the wind pressure H, the batten is not disengaged.

It is to be noted that although, in the foregoings, there are described various embodiments and examples according to the present invention, the present invention is not limited to them and many other changes, modification and combinations thereof may be made without departing from the scopes of the appended claims.

What is claimed is:

1. A multi-window sash comprising a plurality of sash units, to each of which a panel is mounted and which are connected with each other in a panel width direction, and mullion means connecting adjacent two sash units and including at least a mullion having an expandable structure, said expandable mullion means comprising:

a first mullion section having one side surface in a panel width direction provided with a recessed portion and having water-tight member attachments and guide pieces which are attached to respective opposing inner surfaces of the recessed portion; and a second mullion section fitted to the recessed portion of said first mullion section in the panel width direction, wherein water-tight members are mounted to the respective water-tight member attachments so as to be pressed against both side end surfaces in a panel thickness direction of the second mullion section and the guide pieces are disposed so as to oppose to both the side end surfaces in the panel thickness direction of the second mullion section with small gaps, respectively, to thereby impart an expandable function to the first and second mullion sections.

2. A multi-window sash comprising:

a frame structure;

a plurality of sash units, to each of which a panel is mounted and which are connected with each other in a panel width direction, each of said sash units comprising bilateral vertical frame members, an upper frame member and a lower frame member which constitute a rectangular frame of the sash unit in combination thereof; and mullion means connecting adjacent two sash units and including at least a mullion having an expandable structure, said expandable mullion means comprising:

a first mullion section attached to one sash unit and having one side surface in a panel width direction provided with a recessed portion and having water-tight member attachments and guide pieces which are attached to respective opposing inner surfaces of the recessed portion;

water-tight members mounted to the respective water tight member attachments; and a second mullion structure attached to another one sash unit adjacent to said one sash unit and fitted to the recessed portion of said first mullion section in the panel width direction, wherein said water-tight members are mounted so as to be pressed against both side end surfaces in a panel thickness direction of the second mullion section and the guide pieces are disposed so as to oppose to both the side end surfaces in the panel thickness direction of the second mullion section with gaps, respectively, to thereby impart an expandable function to the first and second mullion sections.

3. A multi-window sash according to claim 2, wherein said water-tight member attachments are composed of recessed grooves into which said water-tight members are mounted, respectively, and said guide pieces project over the recessed grooves in the panel thickness direction.

4. A multi-window sash comprising:

a frame structure;

a plurality of sash units, to each of which a panel is mounted which are connected with each other in a panel width direction, each of said sash units comprising bilateral vertical frame members, an upper frame member and a lower frame member which constitute a rectangular frame of the sash unit in combination thereof; and mullion means connecting adjacent two sash units, said mullion means comprising:

an expandable mullion having an expandable structure and including a first mullion section attached to one sash unit and having one side surface in a panel width direction provided with a recessed portion and having water-tight member attachments and guide pieces which are attached to respective opposing inner surfaces of the recessed portion and a second mullion section attached to another one sash unit adjacent to said one sash unit and fitted to the recessed portion of said first mullion section in the panel width direction;

an intermediate mullion comprising a first mullion section having a recessed portion and a second mullion section fitted to the recessed portion of the first mullion section; and a corner mullion connecting adjacent two sash units at a corner portion at which first group and second group of the sash units connected with substantially a right angle therebetween by the corner mullion, said corner mullion comprising: a first hollow structure rectangular in section defined by first, second, third and fourth plate members; a second hollow structure rectangular in section defined by first, second, third and fourth plate members and disposed inside the first hollow structure with third and fourth plate members of the first and second hollow structures being common; a connecting member connecting an inner corner portion between the first and second plate members of the first hollow structure and outer corner portion between the first and second plate members of the second hollow structure; and a reinforcing member disposed between an inner corner portion between the first and second plate members of the second hollow structure and a common corner portion of the first and second hollow structures between the third and fourth plate members thereof, said first and second plate members of the first hollow structure being formed with recessed portions into which panels are mounted with an angle perpendicular to each other.

* * * * *